US012329283B2

(12) United States Patent
Xie et al.

(10) Patent No.: US 12,329,283 B2
(45) Date of Patent: Jun. 17, 2025

(54) FOLDABLE CONNECTION MECHANISM AND ADJUSTABLE BED SYSTEM THEREWITH

(71) Applicant: Nisco Co., Ltd, Rugao (CN)

(72) Inventors: Jian Xie, Rugao (CN); Yifan Mao, Rugao (CN); Jinquan Ren, Rugao (CN); Hailong Sun, Rugao (CN)

(73) Assignee: NISCO CO., LTD, Jiangsu (CN)

( * ) Notice: Subject to any disclaimer, the term of this patent is extended or adjusted under 35 U.S.C. 154(b) by 969 days.

(21) Appl. No.: 17/408,788

(22) Filed: Aug. 23, 2021

(65) Prior Publication Data

US 2021/0378411 A1 Dec. 9, 2021

Related U.S. Application Data

(63) Continuation-in-part of application No. 16/747,842, filed on Jan. 21, 2020, now Pat. No. 11,178,974, which is a continuation-in-part of application No. 16/729,700, filed on Dec. 30, 2019, now Pat. No. 11,317,729, application No. 17/408,788, filed on Aug. 23, 2021 is a continuation-in-part of application No. 16/729,700, filed on Dec. 30, 2019, now Pat. No. 11,317,729.

(60) Provisional application No. 62/796,154, filed on Jan. 24, 2019, provisional application No. 62/796,172, filed on Jan. 24, 2019, provisional application No. 62/789,062, filed on Jan. 7, 2019, provisional application No. 62/789,047, filed on Jan. 7, 2019, (Continued)

(51) Int. Cl.

| | |
|---|---|
| ***A47C 19/12*** | (2006.01) |
| ***A47C 20/04*** | (2006.01) |

(52) U.S. Cl.

CPC ..... *A47C 20/041* (2013.01); *A47C 19/122* (2013.01)

(58) Field of Classification Search

CPC ..... A47C 20/041; A47C 19/12; A47C 19/122; A47C 19/124; E05D 1/04

See application file for complete search history.

(56) References Cited

U.S. PATENT DOCUMENTS

| | | | | |
|---|---|---|---|---|
| 20,112 A * | 4/1858 | Wells | ..... | A47C 19/124 5/240 |
| 271,760 A * | 2/1883 | Allen | ..... | A47C 19/122 5/56 |

(Continued)

*Primary Examiner* — Justin C Mikowski
*Assistant Examiner* — Ifeolu A Adeboyejo
(74) *Attorney, Agent, or Firm* — troutman pepper locke; Tim Tingkang Xia, Esq.

(57) ABSTRACT

An adjustable bed system includes a base frame structure having first and second frames and a foldable connection mechanism connecting the first and second frame such that the first and second frames are pivotally foldable relative to one another at the foldable connection mechanism. The foldable connection mechanism has at least one connecting bracket assembly, each of which includes a first hinge bracket having first and second end portions, and a second hinge bracket having first and second end portions. The first and second hinge brackets are pivotally connected to one another through a pivot at the first ends. The first and second hinge brackets are respectively mounted on two adjacent end portions of the first and second frames such that the first and second frames are capable of positioning in a plane state or a folded state.

17 Claims, 12 Drawing Sheets

Related U.S. Application Data provisional application No. 62/790,583, filed on Jan. 10, 2019.

(56) References Cited

U.S. PATENT DOCUMENTS 572,422 A * 12/1896 Helprin ..... A47C 17/68 5/310
1,039,527 A * 9/1912 Harman ..... A47C 19/122 5/154
1,339,650 A * 5/1920 Haight ..... A47C 19/122 5/154
1,607,572 A * 11/1926 Soderquist ..... A47C 19/122 5/112
2,064,839 A * 12/1936 Kroll ..... E05D 11/1014 182/163
2,568,546 A * 9/1951 Hoeft ..... A47C 19/122 5/174
3,077,612 A * 2/1963 Sevcik ..... A47C 17/48 5/618
6,035,467 A * 3/2000 Lee ..... A47C 17/70 5/174
2006/0123592 A1* 6/2006 Yip ..... E05D 3/10 16/241
2007/0245525 A1* 10/2007 Hoffman ..... B60J 5/0472 16/367
2012/0216371 A1* 8/2012 Schneider ..... E05D 1/06 16/268
2015/0313369 A1* 11/2015 Tarplee ..... A61H 23/0254 601/57
2016/0120740 A1* 5/2016 Rawls-Meehan .... A47C 31/008 601/49
2017/0325592 A1* 11/2017 Suh ..... A47C 17/04
2017/0360209 A1* 12/2017 Zhou ..... A47C 20/041
2018/0042392 A1* 2/2018 Brown ..... A47C 20/12
2018/0116413 A1* 5/2018 Lo ..... A47C 17/82
2018/0116414 A1* 5/2018 Lo ..... A47C 21/046
2018/0235373 A1* 8/2018 Tsai ..... A47C 20/08
2018/0338625 A1* 11/2018 Nava ..... A47C 19/021
2019/0099008 A1* 4/2019 Yin ..... A47C 23/34
2019/0239653 A1* 8/2019 Shan ..... A47C 20/041
2020/0033916 A1* 1/2020 Aagaard ..... G06F 1/1681
2020/0148042 A1* 5/2020 Sullwold ..... E05D 1/04

* cited by examiner

FOLDABLE CONNECTION MECHANISM AND ADJUSTABLE BED SYSTEM THEREWITH

CROSS-REFERENCE TO RELATED PATENT APPLICATIONS

This application is a continuation-in-part of U.S. patent application Ser. No. 16/747,842 filed Jan. 21, 2020, which claims priority to and the benefit of U.S. Provisional Patent Application Ser. Nos. 62/796,154 and 62/796,172 both filed Jan. 24, 2019 and is also a continuation-in-part of U.S. patent application Ser. No. 16/729,700 filed Dec. 30, 2019, which itself claims priority to and the benefit of U.S. Provisional Patent Application Ser. Nos. 62/789,062 filed Jan. 7, 2019, 62/789,047 filed Jan. 7, 2019, and 62/790,583 filed Jan. 10, 2019, which are incorporated herein in their entireties by reference.

This application is also a continuation-in-part of U.S. patent application Ser. No. 16/729,700 filed Dec. 30, 2019, which claims priority to and the benefit of U.S. Provisional Patent Application Ser. Nos. 62/789,062 filed Jan. 7, 2019, 62/789,047 filed Jan. 7, 2019, and 62/790,583 filed Jan. 10, 2019, which are incorporated herein in their entireties by reference.

FIELD OF THE INVENTION

The invention generally relates to a bed, and more particular to foldable connection mechanisms and adjustable bed systems with the foldable connection mechanisms.

BACKGROUND OF THE INVENTION

Sleep is critical for people in every aspect of their lives. Beds are necessary furniture for people to sleep on. A conventional bed usually occupy a relatively large area of the living space for people, and also is not convenient to carry. Thus, it is beneficial and desirable for people to have a bed system that is foldable so as to reduce the space for storage and transportation. In addition, it is also beneficial and desirable that the bed system is capable of adjusting body positions based on user's sleep preference so that the user achieves maximum comfort during sleep.

SUMMARY OF THE INVENTION

In one aspect, the invention relates to an adjustable bed system, comprising a base frame structure having a first frame and a second frame; and a foldable connection mechanism connecting the first frame and the second frame such that the first frame and the second frame are pivotally foldable relative to one another at the foldable connection mechanism. The foldable connection mechanism comprises at least one connecting bracket assembly, each connecting bracket assembly comprising a first hinge bracket having a first end portion and a second end portion, and a second hinge bracket having a first end portion and a second end portion. The first hinge bracket and the second hinge bracket are pivotally connected to one another through a pivot at the first ends, and the first hinge bracket and the second hinge bracket are respectively mounted on two adjacent end portions of the first frame and the second frame such that the first frame and the second frame are capable of positioning in a plane or flat state or a folded state.

In one embodiment, each of the first end portions of the first hinge bracket and the second hinge bracket are constructed to have a hole, such that the first end portions of the first hinge bracket and the second hinge bracket are pivotally connected to one another through a pin or screw.

In one embodiment, the first hinge bracket and the second hinge bracket are constructed such that the first end portions of the first hinge bracket and the second hinge bracket are pivotally connected to one another through a male and female connecting means.

In one embodiment, one of the first end portions of the first hinge bracket and the second hinge bracket has a through hole and the other of the first end portions has a protruded pin or a protruded tube that is rotatably received in said through hole so that the first hinge bracket and the second hinge bracket are rotatable to one another at said protruded pin or tube.

In one embodiment, each of the first hinge bracket and the second hinge bracket is formed in a plane plate, or is formed such that the second end portion is slightly bended from the first end portion.

In one embodiment, a width of the first end portion of each of the first and second hinge brackets is less than that of the second end portion of said hinge bracket.

In one embodiment, each of the first and second hinge brackets is devoid of grooves. The foldable connection mechanism is also devoid of a frame mounting bracket, a latch and a locking device.

In one embodiment, the pivotally connected first end portions of the first hinge bracket and the second hinge bracket are protruded from the first frame and the second frame, such that when the first frame and the second frame are folded in the folded state, the first frame and the second frame are spatially apart by a distance thereby providing a space for accommodating a back lifting assembly and a leg lifting assembly of the adjustable bed system in the folded state.

In one embodiment, the foldable connection mechanism further comprises a latch, and wherein each of the first hinge bracket and the second hinge bracket has a groove defined in the second end portion of said hinge bracket. When the latch is received in the grooves of the first hinge bracket and the second hinge bracket, the first frame and the second frame are locked and aligned in the same plane, and when the latch is off at least one of the grooves of the first hinge bracket and the second hinge bracket, the first frame and the second frame are unlocked and pivotally foldable to each other through the pivot.

In one embodiment, each connecting bracket assembly further comprises a frame mounting bracket having a body and two end tabs vertically extended from the body, and two protrusions outwards protruded from the two end tabs, respectively. In use, the body of the frame mounting bracket is mounted on one of the first frame and the second frame proximal to a corresponding one of the first hinge bracket and the second hinge bracket.

In one embodiment, the latch comprises a pin and a tab having a first end vertically attached to a first end of the pin and a second end portion defining a notch. In use, when the pin is placed in the grooves of the first hinge bracket and the second hinge bracket and the tab is positioned such that the proximal protrusion of the frame mounting bracket is received in the notch, the first frame and the second frame are locked and aligned in the same plane, and when the pin is off at least one of the grooves of the first hinge bracket and the second hinge bracket the tab is positioned such that the distal protrusion of the frame mounting bracket is received in the notch, the first frame and the second frame are unlocked and pivotally foldable to each other through the pivot.

In one embodiment, each of the first and second frames comprises a pair of side rails and being transversely spaced and longitudinally extended and being parallel to each other, each side rail and having a first end and an opposite, second end; and an upper rail and a lower rail being longitudinally spaced and transversely extended, two ends of the upper rail being rigidly connected to the first ends of the pair of side rails and, and two ends of lower rail being rigidly connected to the second ends of the pair of side rails and, such that the upper rail and the lower rail and the pair of side rails are co-planar in a rectangle form.

In one embodiment, the adjustable bed system further comprises at least one of a back lifting assembly and a leg lifting assembly. The back lifting assembly comprises a back lifting bracket pivotally connected to the first frame, and at least one back lifting actuator pivotally connected between the back lifting bracket and the first frame for operably driving the back lifting bracket to pivotally move in an upward rotating direction or a downward rotating direction relative to the first frame. The leg lifting assembly comprises a leg lifting bracket pivotally connected to the second frame structure, and at least one leg lifting actuator pivotally connected between the leg lifting bracket and the second frame for operably driving the leg lifting bracket to pivotally move in an upward rotating direction or a downward rotating direction relative to the second frame.

In one embodiment, the at least one back lifting actuator comprises a motor member, an outer tube extending from the motor member, and an activation rod having a first end portion received in the outer tube and an opposite, second end portion, wherein the activation rod is engaged with the motor member and configured to be telescopically movable relative to the outer tube according to a direction of motor rotation, wherein the motor member is pivotally connected to the first frame and the second end portion of the activation rod pivotally connected to the back lifting bracket, or wherein the motor member is pivotally connected to the back lifting bracket and the second end portion of the activation rod pivotally connected to the first frame.

In one embodiment, the at least one leg lifting actuator comprises the at least one back lifting actuator comprises a motor member, an outer tube extending from the motor member, and an activation rod having a first end portion received in the outer tube and an opposite, second end portion, wherein the activation rod is engaged with the motor member and configured to be telescopically movable relative to the outer tube according to a direction of motor rotation, wherein the motor member is pivotally connected to the second frame and the second end portion of the activation rod pivotally connected to the leg lifting bracket, or wherein the motor member is pivotally connected to the leg lifting bracket and the second end portion of the activation rod pivotally connected to the second frame.

In one embodiment, the adjustable bed system further comprises a plurality of platforms disposed on the base frame structure and coupled with the back lifting assembly and the leg lifting assembly such that positions of at least one or more of the plurality of platforms are adjustable in accordance with operations of the back lifting assembly and the leg lifting assembly.

In one embodiment, the plurality of platforms comprises at least one seat platform and mounted on the two side rails of the base frame structure; a back platform coupled to the back lifting assembly, such that the back platform is operably rotatable around its lower edge in a back platform downward rotating direction or a back platform upward rotating direction; and a thigh platform and a leg platform coupled to the led lifting assembly, such that the thigh platform is rotatable around its upper edge in a thigh platform downward rotating direction or a thigh platform upward rotating direction, and the leg platform is rotatable around its upper edge in a leg platform downward rotating direction or a led platform upward rotating direction.

In one embodiment, the adjustable bed system further comprises at least one massage device accommodated in at least one of the plurality of platforms for providing massage effects to a user of the adjustable bed system.

In one embodiment, the at least one massage device comprises a massage motor, and an elastic belt passing through a side of the massage motor and fastening the massage motor onto the at least one of the plurality of platforms.

In one embodiment, the adjustable bed system further comprises a controller configured to control operations of the at least one back lifting actuator, the at least one leg lifting actuator, and the at least one massage device, so as to lift individually or cooperatively the back platform, the thigh platform, and the leg platform in desired positions, and provide massage effects.

These and other aspects of the invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
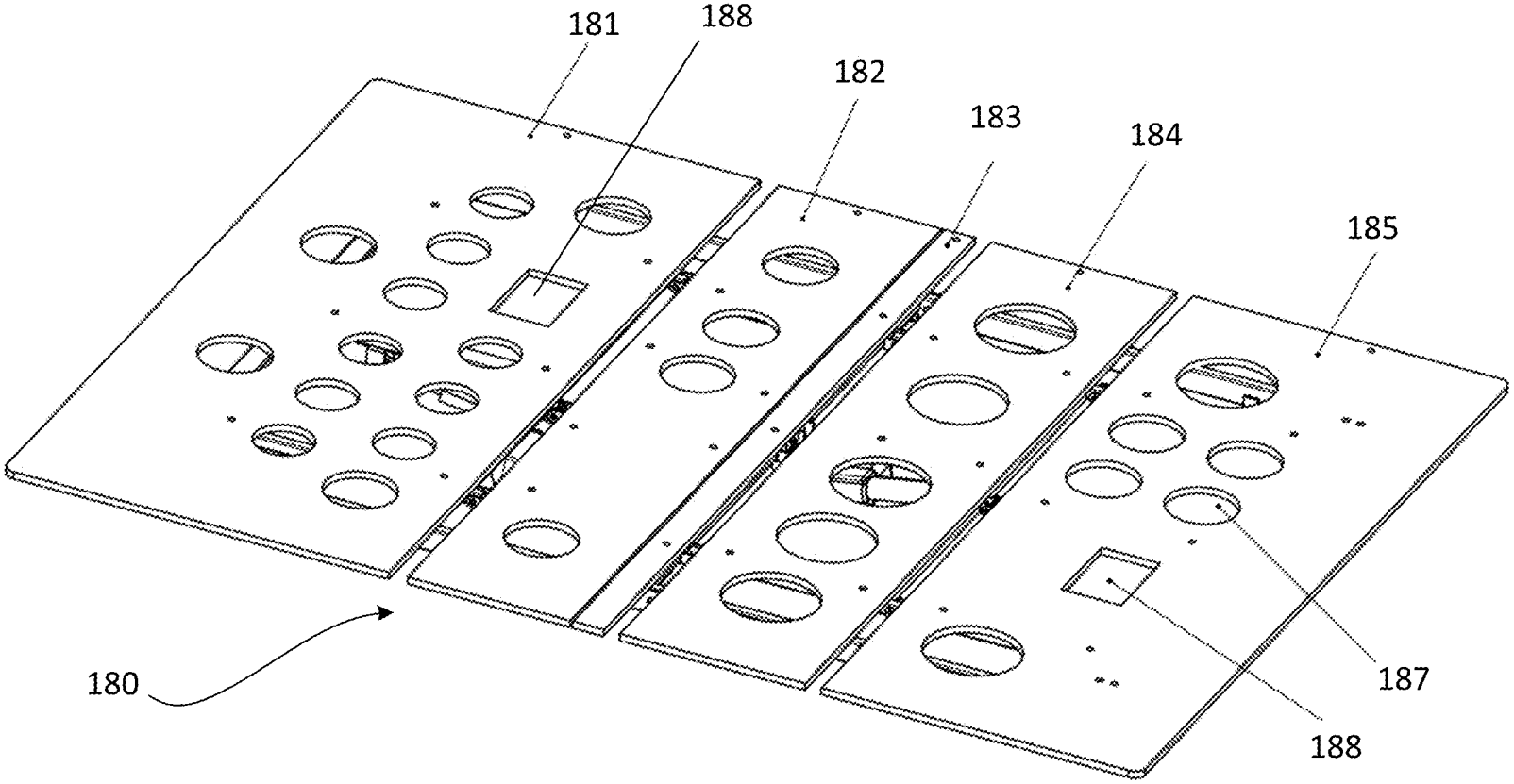
FIG. 1 shows schematically a front perspective view of an adjustable bed system with bed platforms/boards in a plane state according to one embodiment of the invention.

The present invention will now be described more fully hereinafter with reference to the accompanying drawings, in which exemplary embodiments of the present invention are shown. The present invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting and/or capital letters has no influence on the scope and meaning of a term; the scope and meaning of a term are the same, in the same context, whether or not it is highlighted and/or in capital letters. It will be appreciated that the same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only and in no way limits the scope and meaning of the invention or of any exemplified term. Likewise, the invention is not limited to various embodiments given in this specification.

The terminology used herein is for the purpose of describing particular embodiments only and is not intended to be limiting of the invention. As used herein, the singular forms "a," "an," and "the" are intended to include the plural forms as well, unless the context clearly indicates otherwise.

It will be understood that when an element is referred to as being "on," "attached" to, "connected" to, "coupled" with, "contacting," etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" to another feature may have portions that overlap or underlie the adjacent feature.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below can be termed a second element, component, region, layer or section without departing from the teachings of the present invention.

Furthermore, relative terms, such as "lower" or "bottom" and "upper" or "top," may be used herein to describe one element's relationship to another element as illustrated in the figures. It will be understood that relative terms are intended to encompass different orientations of the device in addition to the orientation shown in the figures. For example, if the device in one of the figures is turned over, elements described as being on the "lower" side of other elements would then be oriented on the "upper" sides of the other elements. The exemplary term "lower" can, therefore, encompass both an orientation of lower and upper, depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

It will be further understood that the terms "comprise(s)" and/or "comprising," or "include(s)" and/or "including" or "has (have)" and/or "having" or "contain(s)" and/or "containing" when used in this specification specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around," "about," "substantially" or "approximately" shall generally mean within 20 percent, preferably within 10 percent, and more preferably within 5 percent of a given value or range. Numerical quantities given herein are approximate, meaning that the terms "around," "about," "substantially" or "approximately" can be inferred if not expressly stated.

As used in this specification, the phrase "at least one of A, B, and C" should be construed to mean a logical (A or B or C), using a non-exclusive logical OR. As used herein, the term "and/or" includes any and all combinations of one or more of the associated listed items.

The description below is merely illustrative in nature and is in no way intended to limit the invention, its application, or uses. The broad teachings of the invention can be implemented in a variety of forms. Therefore, while this invention includes particular examples, the true scope of the invention should not be so limited since other modifications will become apparent upon a study of the drawings, the specification, and the following claims. For purposes of clarity, the same reference numbers will be used in the drawings to identify similar elements. It should be understood that one or more steps within a method may be executed in different order (or concurrently) without altering the principles of the invention.

The description will be made as to the embodiments of the invention in conjunction with the accompanying drawings in FIGS. 1-11. In accordance with the purposes of this invention, as embodied and broadly described herein, this invention, in one aspect, relates to an adjustable bed system with a foldable connection mechanism.

Referring to FIGS. 1-7, and particularly to FIGS. 2-5, the adjustable bed system includes a base frame structure 101, a back lifting assembly 103, a leg lifting assembly 105, and a foldable connection mechanism 270.

In this exemplary embodiment, the base frame structure 101 has a first frame 110 and a second frame 120.

Figure 3:
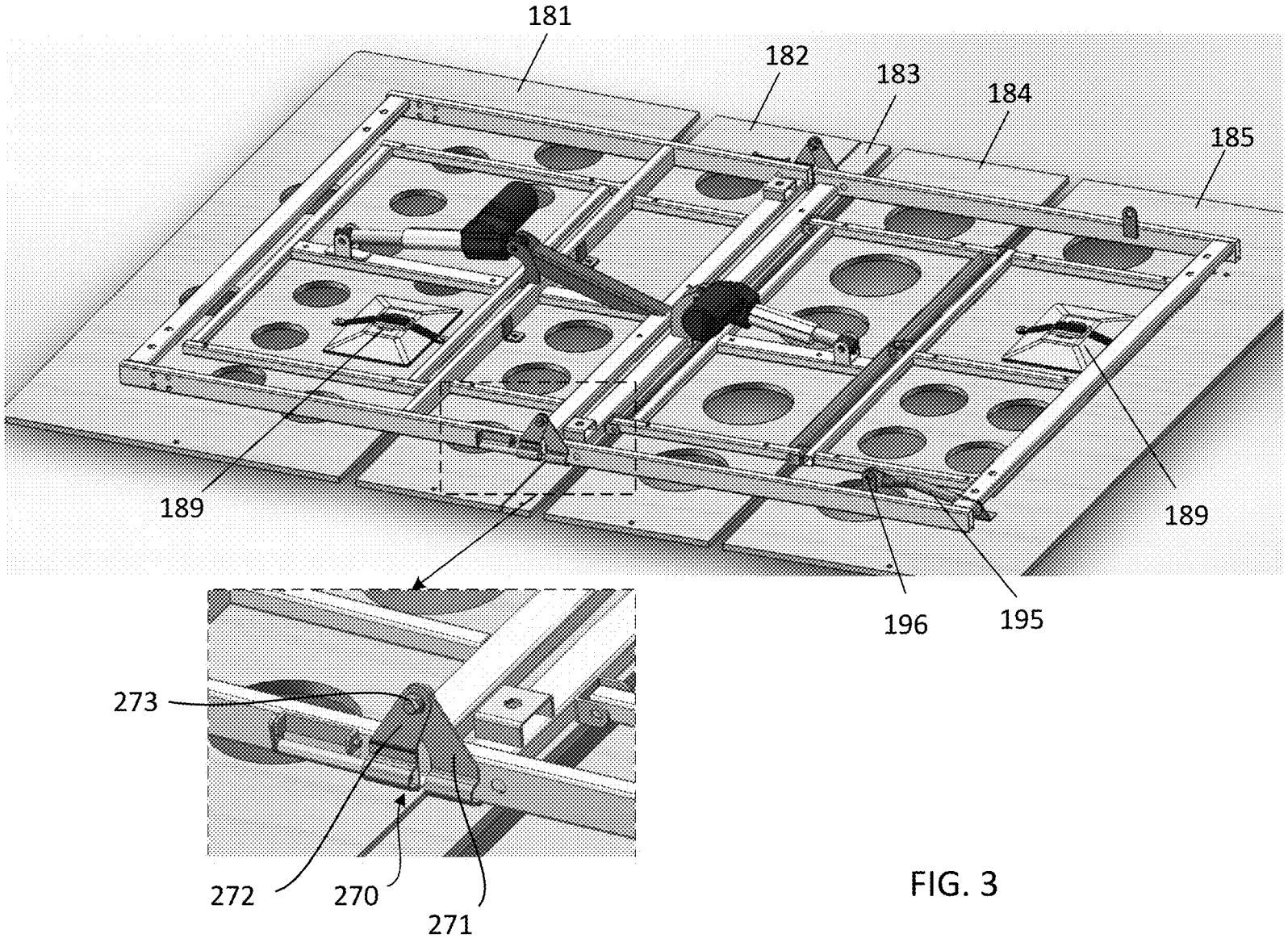
FIG. 3 shows schematically a back perspective view of the adjustable bed system shown in FIG. 1 in the plane state.

The first frame 110 includes a pair of side rails 111 and 112 being transversely spaced and longitudinally extended and being parallel to each other, and an upper rail 113 and a lower rail 114 being longitudinally spaced and transversely extended. Each side rail 111/112 has a first end and an opposite, second end. Two ends of the upper rail 113 are rigidly connected to the first ends of the pair of side rails 111 and 112, respectively, and two ends of the lower rail 114 are rigidly connected to the second ends of the pair of side rails 111 and 112, respectively. As such the upper rail 113 and the lower rail 114 and the pair of side rails 111 and 112 are co-planar in a rectangle form. In addition, the first frame 110 may optionally include a middle rail 115 locating between the upper rail 113 and the lower rail 114, and having two ends being rigidly connected to the pair of side rails 111 and 112. Optionally, the first frame 110 may also have a plurality of frame reinforcement bars 116*a*, 116*b*, 116*c* and 116*d* being rigidly connected to the lower rail 114 and the middle rail 115, as shown in FIG. 3.

The second frame 120 includes a pair of side rails 121 and 122 being transversely spaced and longitudinally extended and being parallel to each other, and an upper rail 123 and a lower rail 124 being longitudinally spaced and transversely extended. Each side rail 121/112 has a first end and an opposite, second end. Two ends of the upper rail 123 are rigidly connected to the first ends of the pair of side rails 121 and 122, respectively, and two ends of the lower rail 124 are rigidly connected to the second ends of the pair of side rails 121 and 122, respectively. As such, the upper rail 123 and the lower rail 124 and the pair of side rails 121 and 122 are co-planar in a rectangle form.

The back lifting assembly 103 includes a back lifting bracket 130 pivotally connected to the first frame 110, and at least one back lifting actuator 140 pivotally connected between the back lifting bracket 130 and the first frame 110 for operably driving the back lifting bracket 130 to pivotally move in an upward rotating direction or a downward rotating direction relative to the first frame 110.

In this exemplary embodiment shown FIGS. 2-4 and 7A-7D, the back lifting bracket 130 includes two arms 131 and 132 and a reinforcement bar 135 being transversely spaced and longitudinally extended, an upper bar 133 and a lower bar 134 being longitudinally spaced and transversely extended. The first ends of the two arms 131 and 132 are rigidly connected to the upper bar 133 and the second ends of the two arms 131 and 132 are pivotally connected to the middle rail 115 of the first frame 110. The lower bar 134 is rigidly connected to the two arms 131 and 132 at positions proximal to the second ends of the two arms 131 and 132, and the reinforcement bar 135 is rigidly connected to the middles of the upper bar 133 and the lower bar 134.

In some embodiments, the back lifting bracket may be designed in other forms. For example, as disclosed in U.S. patent application Ser. No. 16/729,700, which is incorporated herein in its entirety by reference, the back lifting bracket has a middle bar and a pair of swing arms. The pair of swing arms is transversely spaced and longitudinally extended, and rigidly connected to ends of the transversely extending middle bar in an H-shaped form. Each of the pair of swing arms has a first end portion and an opposite, second end portion, where the first end portions of the pair of swing arms are pivotally connected to the two side rails of the first frame, respectively.

In this exemplary embodiment shown FIGS. 2-4 and 7A-7D, the at least one back lifting actuator 140 comprises a motor member 141, an outer tube 142 extending from the motor member 141, and an activation rod 143 having a first end portion received in the outer tube 142 and an opposite, second end portion. The activation rod 143 is engaged with the motor member 141 and configured to be telescopically movable relative to the outer tube 142 according to a direction of motor rotation. The motor member 141 is pivotally connected to the first frame 110, for example, to the middle rail 115 of the first frame 110 through a bracket 145. The second end portion of the activation rod 143 is pivotally connected to the back lifting bracket 130, for example, to the reinforcement bar 135 through a bracket 144.

In some embodiments, the motor member 141 can be pivotally connected to the back lifting bracket 130 and the second end portion of the activation rod 143 pivotally connected to the first frame 110.

The leg lifting assembly 105 includes a leg lifting bracket 150 pivotally connected to the second frame structure 120, and at least one leg lifting actuator 160 pivotally connected between the leg lifting bracket 150 and the second frame 120 for operably driving the leg lifting bracket 150 to pivotally move in an upward rotating direction or a downward rotating direction relative to the second frame 120.

In this exemplary embodiment shown FIGS. 2-4 and 7A-7D, the leg lifting bracket 150 has a first lifting bracket 151 and a second lifting bracket 155 pivotally connected to the first lifting bracket 151. The first lifting bracket 151 includes two arms 152*a* and 152*b* and a reinforcement bar 153 being transversely spaced and longitudinally extended, an upper bar 154*a* and a lower bar 154*b* being longitudinally spaced and transversely extended. The first ends of the two arms 152*a* and 152*b* are pivotally connected to the upper rail 123 of the second frame 120. The lower bar 154*b* is rigidly connected to the two arms 152*a* and 152*b* at positions proximal to the second ends of the two arms 152*a* and 152*b*. The upper bar 154*a* is rigidly connected to the two arms 152*a* and 152*b* at positions proximal to the first ends of the two arms 152*a* and 152*b*, and the reinforcement bar 153 is rigidly connected to the middles of the upper bar 154*a* and the lower bar 154*b*.

The second lifting bracket 155 has two arms 156*a* and 156*b* and a reinforcement bar 157 being transversely spaced and longitudinally extended, an upper bar 158*a* and a lower bar 158*b* being longitudinally spaced and transversely extended. The first ends of the two arms 156*a* and 156*b* are pivotally connected to the second ends of the two arms 152*a* and 152*b* of the first lifting bracket 151, respectively. The second ends of the two arms 156*a* and 156*b* are rigidly connected to the lower bar 158*b*. The upper bar 158*a* is rigidly connected to the two arms 156*a* and 156*b* at positions proximal to the first ends of the two arms 156*a* and 156*b*, and the reinforcement bar 157 is rigidly connected to the middles of the upper bar 158*a* and the lower bar 158*b*.

In some embodiments, the leg lifting bracket may be designed in other forms. For example, as disclosed in U.S. patent application Ser. No. 16/729,700, which is incorporated herein in its entirety by reference, the back lifting bracket has a middle bar and a pair of swing arms. The pair of swing arms is transversely spaced and longitudinally extended, and rigidly connected to ends of the transversely extending middle bar in an H-shaped form. Each of the pair of swing arms has a first end portion and an opposite, second end portion, where the first end portions of the pair of swing arms are pivotally connected to the two side rails of the first frame, respectively.

In this exemplary embodiment shown FIGS. 2-4 and 7A-7D, the at least one back lifting actuator 160 comprises a motor member 161, an outer tube 162 extending from the motor member 161, and an activation rod 163 having a first end portion received in the outer tube 162 and an opposite, second end portion. The activation rod 163 is engaged with the motor member 161 and configured to be telescopically movable relative to the outer tube 162 according to a direction of motor rotation. The motor member 161 is pivotally connected to the second frame 120, for example, to the upper rails 123 of the second frame 120. The second end portion of the activation rod 163 pivotally connected to the leg lifting bracket 150, for example, to the reinforcement bar 153 of the first lifting bracket 151 of the leg lifting bracket 150.

In some embodiments, the motor member 161 may be pivotally connected to the leg lifting bracket 130 and the second end portion of the activation rod 163 pivotally connected to the second frame 120.

In this exemplary embodiment shown FIGS. 2-4 and 7A-7D, the foldable connection mechanism 270 is used to connect the first frame 110 and the second frame 120 such that the first frame 110 and the second frame 120 are pivotally foldable relative to one another at the foldable connection mechanism 270.

As shown in FIGS. 6A-6D, in one embodiment, each connecting bracket assembly 270 has a latch 277; and a first hinge bracket 271 having a first end portion 271*a* and a second end portion 271*b*, and a second hinge bracket 272 having a first end portion 272*a* and a second end portion 272*b*. The first hinge bracket 271 and the second hinge bracket 272 are pivotally connected to one another through a pivot 273 at the first ends 271*a* and 272*a*. The pivot 273 is corresponding to a screw or pin (FIG. 3). Each of the first hinge bracket 271 and the second hinge bracket 272 has a groove 271*c*/272*c* defined in the second end portion 271*b*/272*b* of said hinge bracket 271/272.

In use, the first hinge bracket 271 and the second hinge bracket 272 are respectively mounted on two adjacent end portions of the first frame and the second frame of the adjustable bed system such that when the latch 277 is received in the grooves 271*c* and 272*c* of the first hinge bracket 271 and the second hinge bracket 272, the first frame and the second frame are locked and aligned in the same plane, and when the latch 277 is off at least one of the grooves 271*c* and 272*c* of the first hinge bracket 271 and the second hinge bracket 272, the first frame and the second frame are unlocked and pivotally foldable to each other through the pivot 273.

Figure 6C:
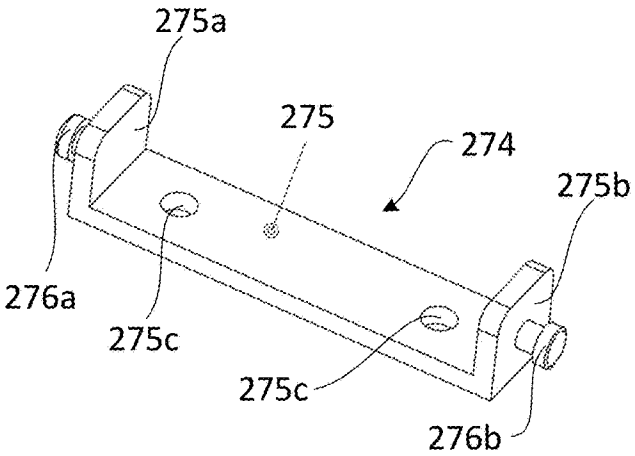
FIGS. 6A-6D show schematically different components of a connection mechanism used for the adjustable bed system shown in FIG. 4.

In addition, as shown in FIG. 6C, each connecting bracket assembly 270 may further have a frame mounting bracket 274 having a body 275 and two end tabs 275*a* and 275*b* vertically extended from the body, and two protrusions 276*a* and 276*b* outwards protruded from the two end tabs 275*a* and 275*b*, respectively. In use, the body 275 of the frame mounting bracket 274 is mounted on one of the first frame and the second frame proximal to a corresponding one of the first hinge bracket 271 and the second hinge bracket 272.

Figure 6D:
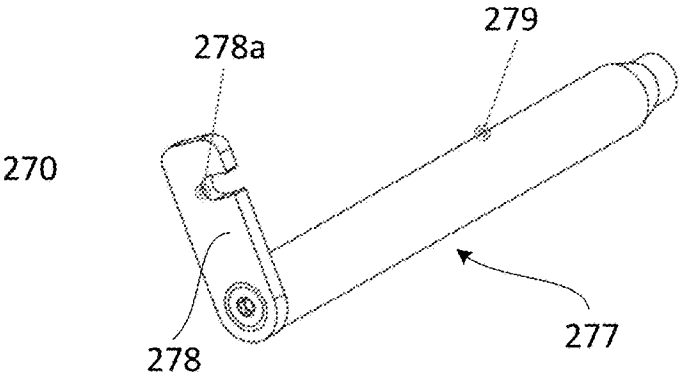

In one embodiment shown in FIG. 6D, the latch 277 may include a pin 279 and a tab 278 having a first end vertically attached to a first end of the pin 279 and a second end portion defining a notch 278*a*. In use, when the pin 279 is placed in the grooves 271*c* and 272*c* of the first hinge bracket 271 and the second hinge bracket 272 and the tab 278 is positioned such that the proximal protrusion 276*a* of the frame mounting bracket 274 is received in the notch 278*a*, the first frame and the second frame are locked and aligned in the same plane, and when the pin 279 is off at least one of the grooves 271*c* and 272*c* of the first hinge bracket 271 and the second hinge bracket 272 the tab 278 is positioned such that the distal protrusion 276*b* of the frame mounting bracket 274 is received in the notch 278*a*, the first frame and the second frame are unlocked and pivotally foldable to each other through the pivot 273.

Practically, the foldable connection mechanism 270 having a pair of connecting bracket assembly 270 is used. To be concise, the following description is given for one connecting bracket assembly 270 only.

As shown in FIGS. 7A-7D, as assembled, the first hinge bracket 271 and the second hinge bracket 272 are respectively mounted on two adjacent end portions of the first side rails 111 and 112 of the first frame 110 and the second frame 120. The body 275 of the frame mounting bracket 274 is mounted on the first side rail 111 of the first frame 110 proximal to the second hinge bracket 272.

Figure 7A:
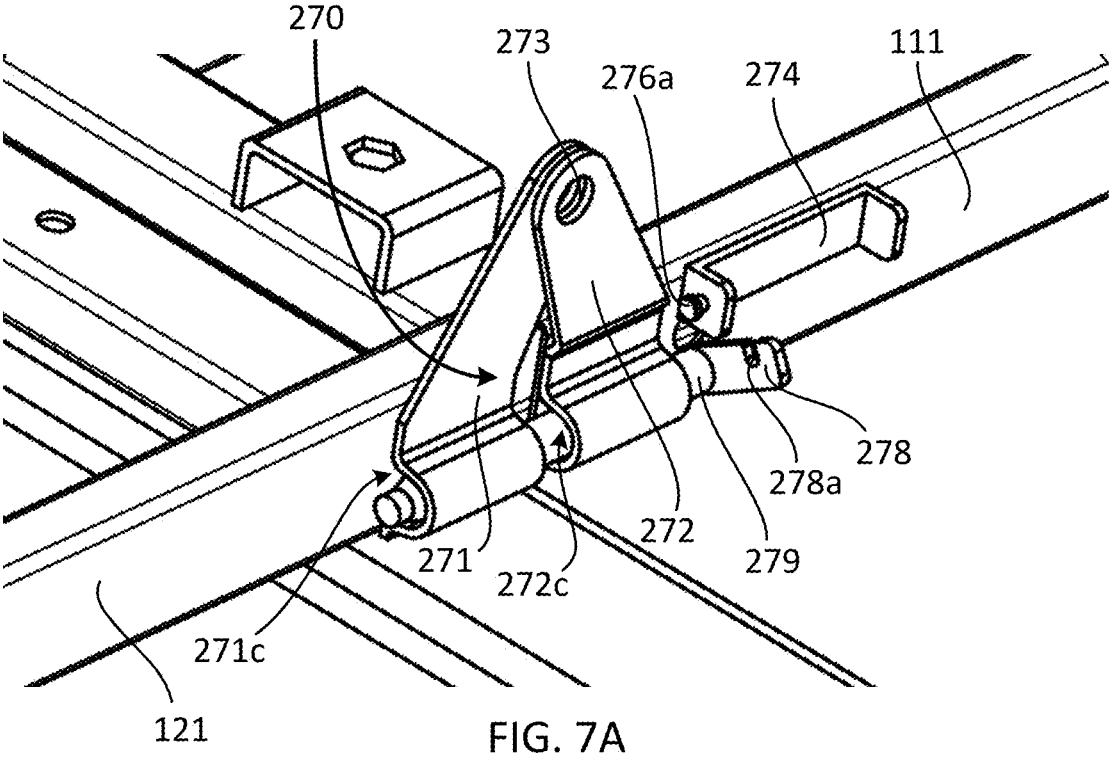
FIGS. 7A-7D show schematically partial views of the adjustable bed system having the connection mechanism shown in FIGS. 6A-6D.
Figure 7B:
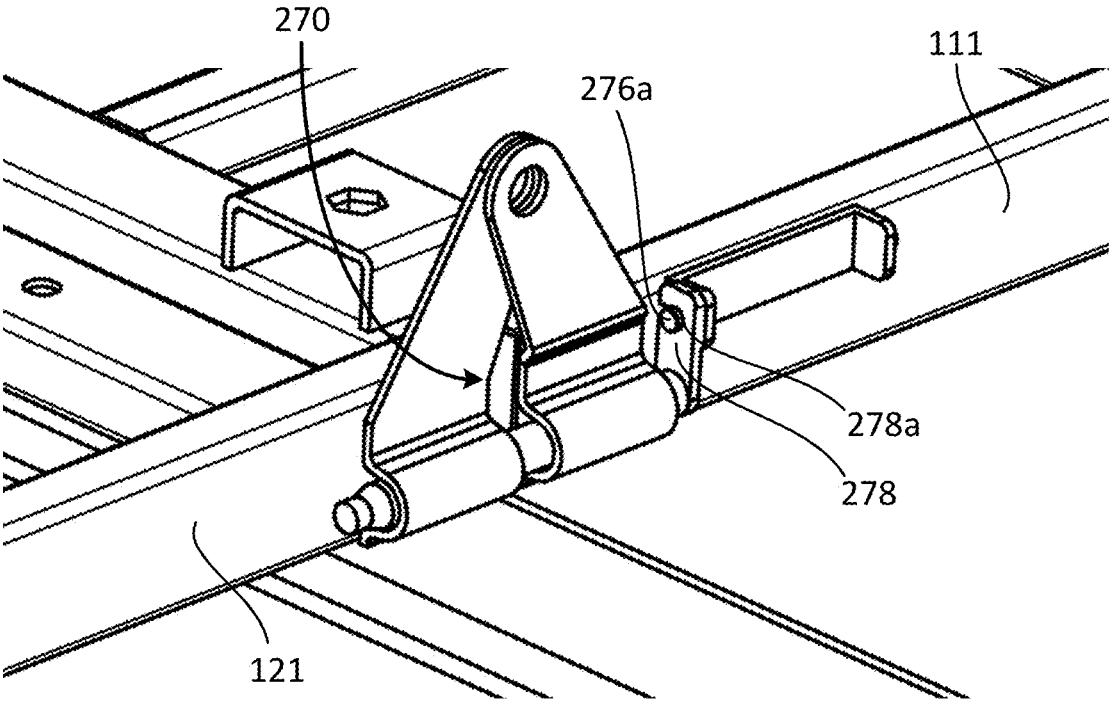

In operation, the pin 279 is placed in the grooves 271*c* and 272*c* of the first hinge bracket 271 and the second hinge bracket 272 and the tab 278 is adjusted (FIG. 7A) and positioned so that the proximal protrusion 276*a* of the frame mounting bracket 274 is received in the notch 278*a* (FIG. 7B), the side rail 111 of the first frame 120 and the side rail 121 of the second frame 120 are locked and aligned in the same plane, as shown in FIG. 7B. Accordingly, the adjustable bed system 200 is in the plane state and ready for use.

Figure 4:
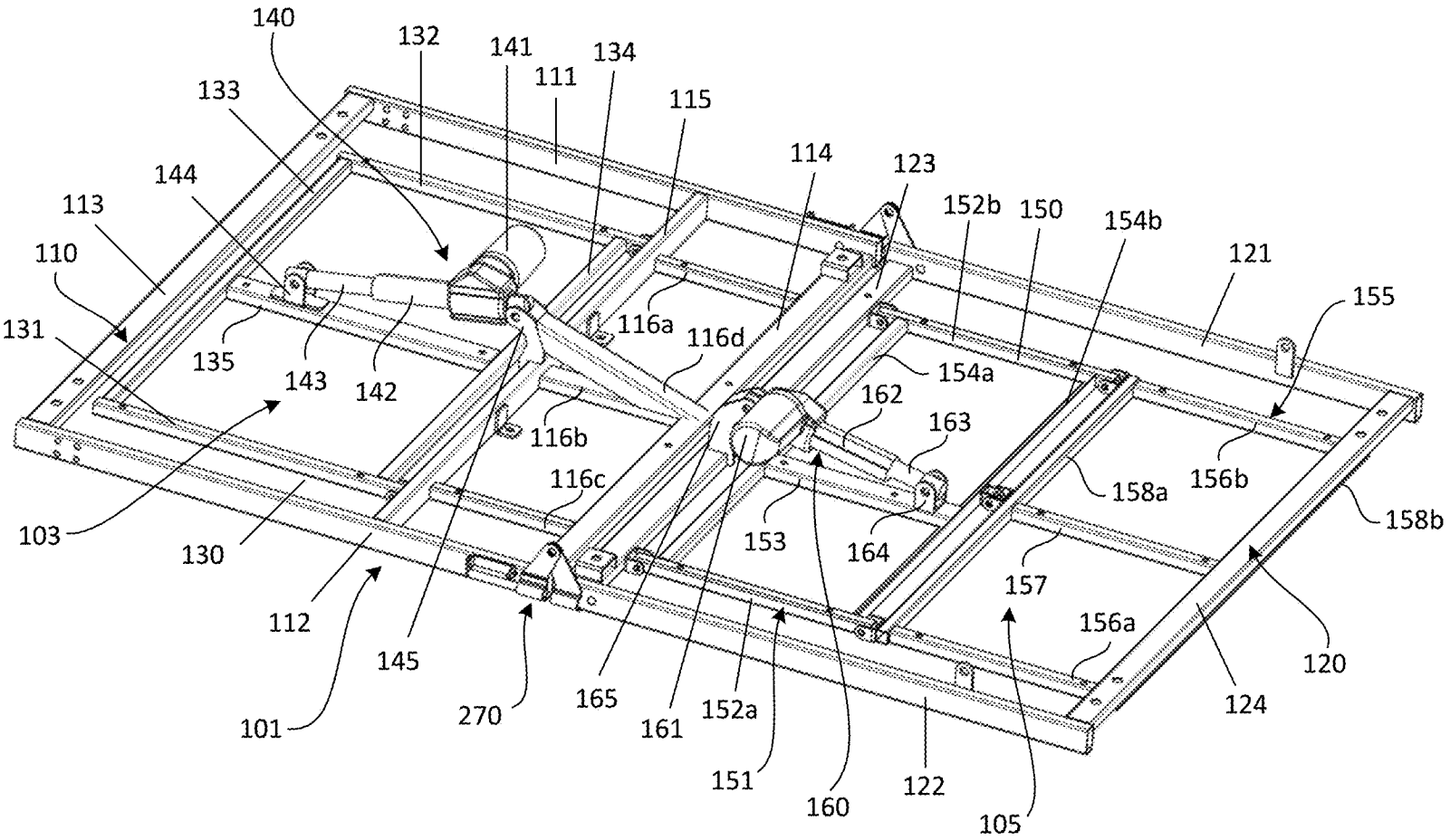
FIG. 4 shows schematically a perspective view of the adjustable bed system shown in FIG. 1 in the plane state (the bed platforms/boards are not shown).
Figure 5:
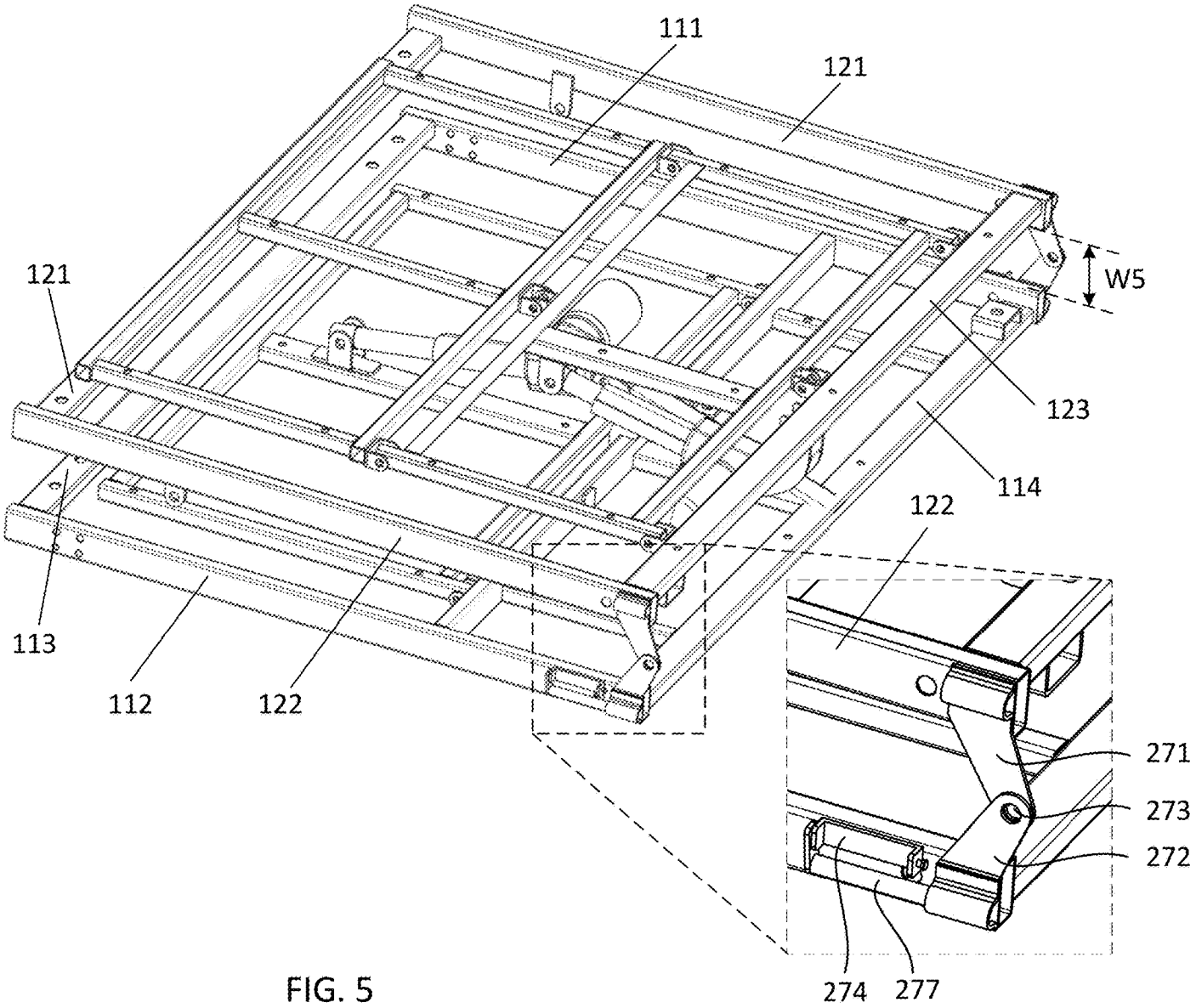
FIG. 5 shows schematically a perspective view of the adjustable bed system shown in FIG. 4 in the folded state.
Figure 7D:
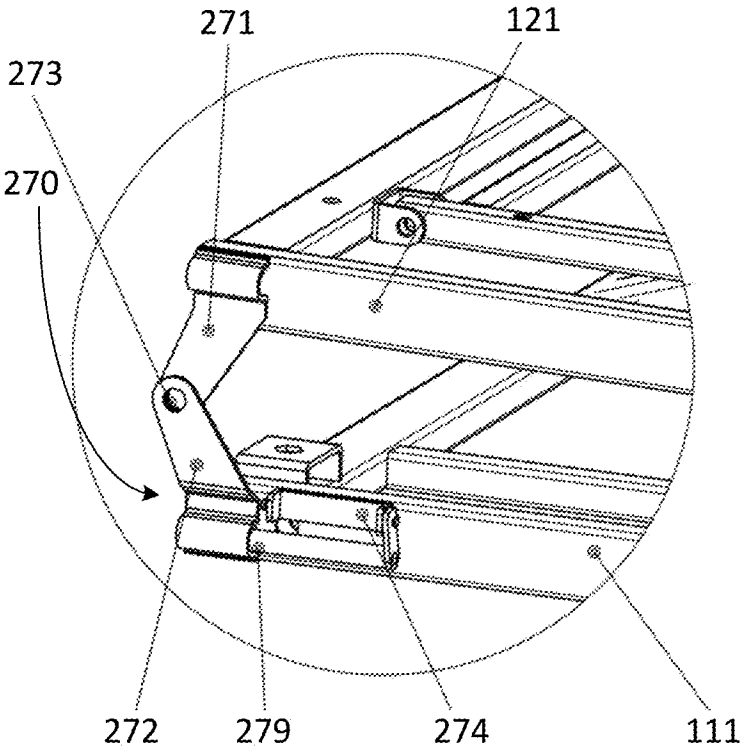
Figure 7C:
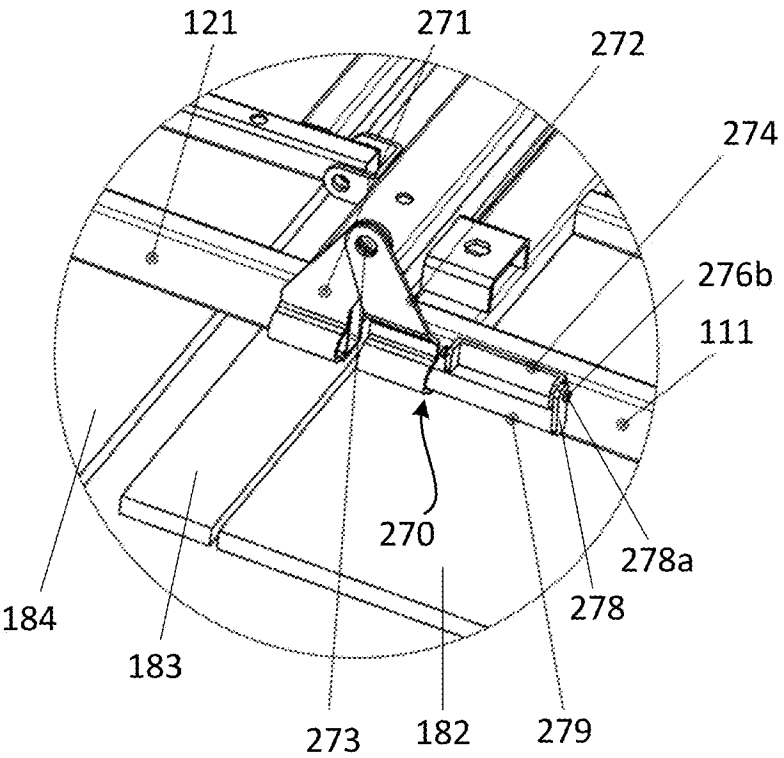

When the pin 279 is off the groove 271*c* of the first hinge bracket 271, the tab 278 is adjusted and positioned so that the distal protrusion 276*b* of the frame mounting bracket 274 is received in the notch 278*a*, the side rail 111 of the first frame 120 and the side rail 121 of the second frame 120 are unlocked, as shown in FIGS. 4 and 7C. In this case, the first frame 110 and the second frame 120 can be pivotally folded to each other through the pivot 273 in the folded state, as shown in FIGS. 5 and 7D. As such, the first frame 110 and the second frame 120 are spatially apart by the distance W5, which provides a space for accommodating the back lifting assembly 103 and the leg lifting assembly 105 in the folded state, as shown in FIG. 5.

Figure 8A:
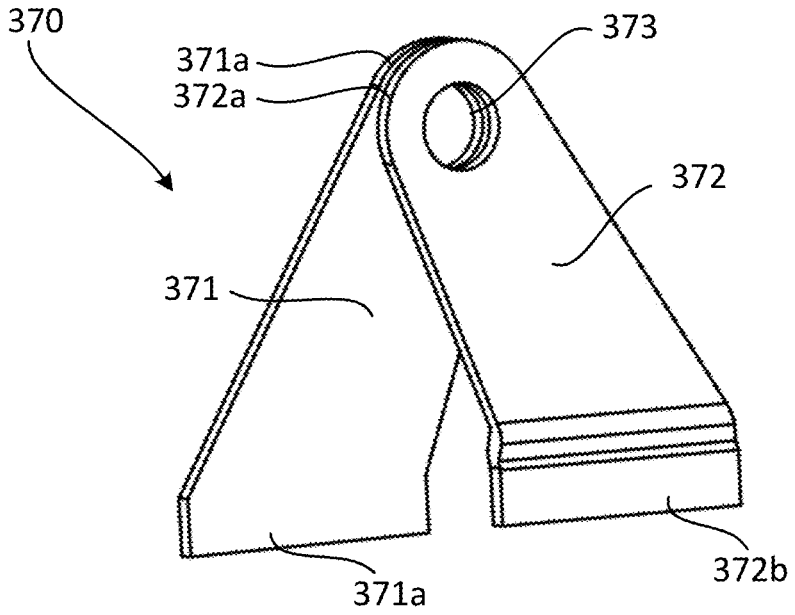
FIGS. 8A-8B show schematically another embodiment of a connection mechanism used for the adjustable bed system shown in FIG. 1.
Figure 8B:
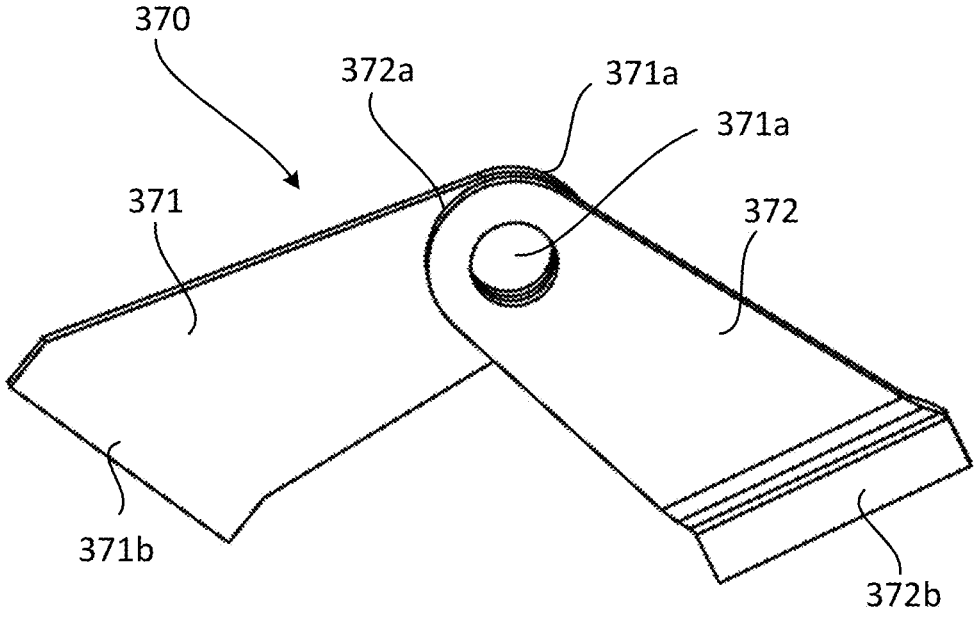

Alternatively, the foldable connection mechanism may be designed in other forms. For example, as shown in FIGS. 8A-8B, the foldable connection mechanism 370 includes a first hinge bracket 371 having a first end portion 371*a* and a second end portion 371*b*, and a second hinge bracket 372 having a first end portion 372*a* and a second end portion 372*b*. Each of the first hinge bracket 371 and the second hinge bracket 372 is formed in a plane plate, or is formed such that the second end portion 371*b*/372*b* is slightly bended from the first end portion 371*a*/372*a* (FIGS. 8A-8B). In one embodiment, a width of the first end portion 371/372*a* of each hinge bracket 371/372 is less than that of the second end portion 371*b*/372*b* of said hinge bracket 371/372. The first hinge bracket 371 and the second hinge bracket 372 are pivotally connected to one another through a pivot 373 at the first end portions 371*a* and 372*a* (FIGS. 9A-9B and 10A-10B). The second end portions 371*b* and 372*b* are configured to connect to two adjacent end portions of the first side rails 111 and 112 of the first frame 110 and the second frame 120, respectively, such that the first frame 110 and the second frame 120 are pivotally foldable relative to one another at the foldable connection mechanism 370.

Figure 9B:
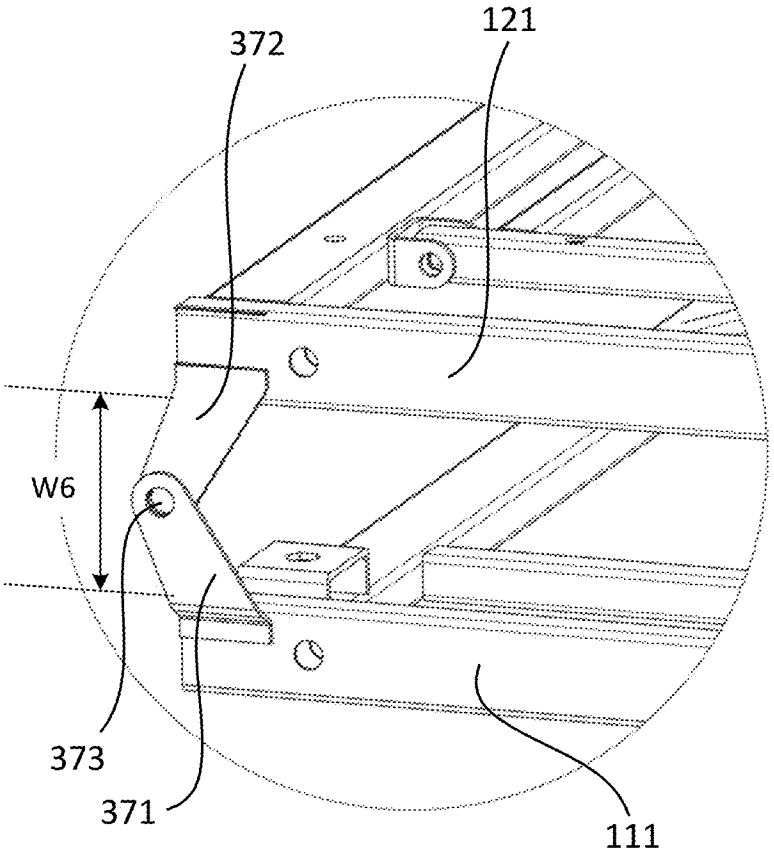
FIGS. 9A-9B show schematically partial views of the adjustable bed system having the connection mechanism shown in FIGS. 8A-8D.
Figure 9A:
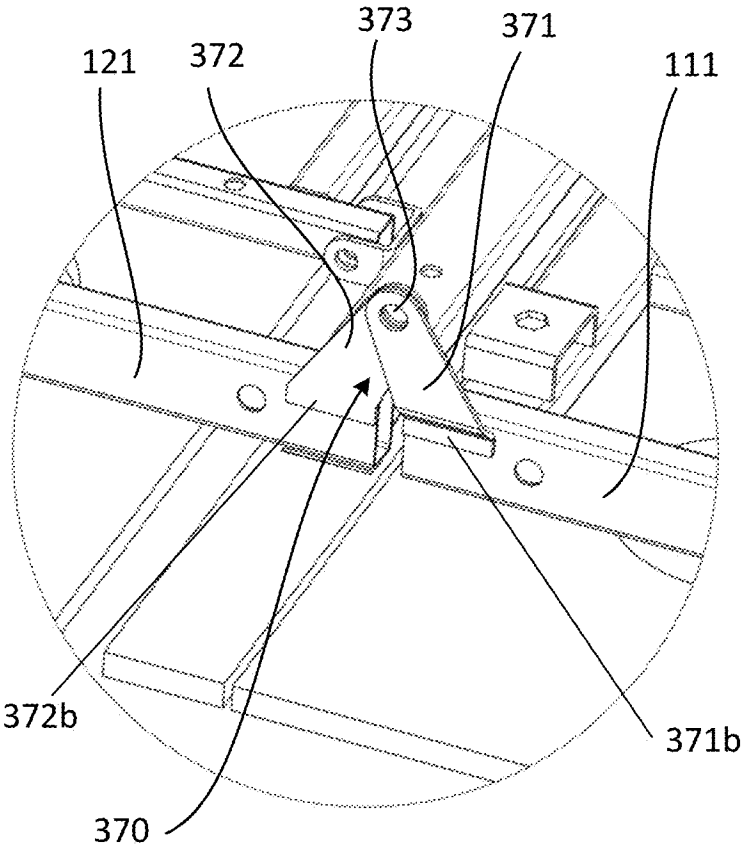

In one embodiment, the first hinge bracket 371 and the second hinge bracket 372 are constructed such that the first end portions 371*a* and 372*a* of the first hinge bracket 371 and the second hinge bracket 372 are pivotally connected to one another through male and female connecting means. For example, one of the first end portions 371*a* and 372*a* of the first hinge bracket 371 and the second hinge bracket 372 has a hole (e.g., hole 373) and the other of the first end portions 371*a* and 372*a* has a protruded pin (not shown) or a protruded tube that is rotatably received in said hole so that the first hinge bracket 371 and the second hinge bracket 372 are rotatable to one another at said protruded pin or tube 373 (FIGS. 9A-9B).

Figure 10B:
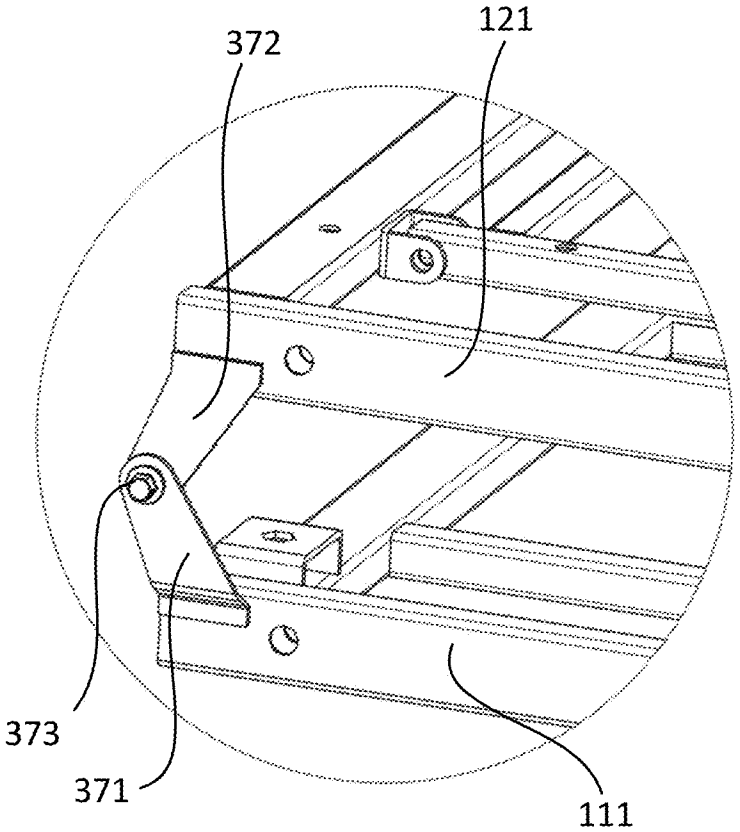
FIGS. 10A-10B show schematically partial views of the adjustable bed system having the connection mechanism shown in FIGS. 8A-8D.
Figure 10A:
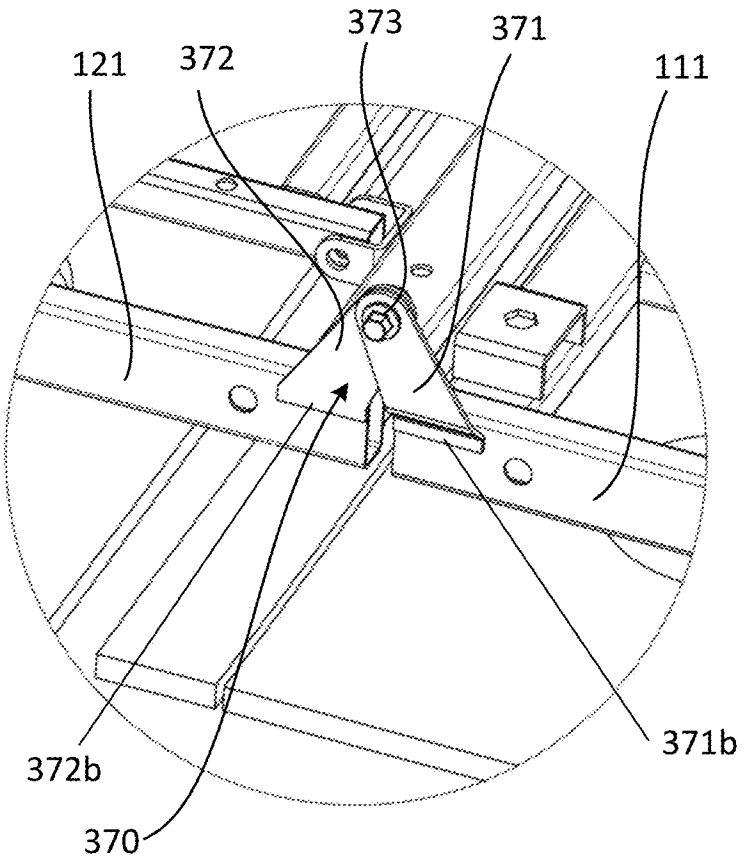

In another embodiment, each of the first end portions 371*a* and 372*a* of the first hinge bracket 371 and the second hinge bracket 372 are constructed to have a hole, such that the first end portions 371*a* and 372*a* of the first hinge bracket 371 and the second hinge bracket 372 are pivotally connected to one another through a pin or screw (FIG. 10A-10B).

In use, the second end portions 371*b* and 372*b* of the first hinge bracket 371 and the second hinge bracket 372 are respectively mounted on two adjacent end portions of the first frame 110 and the second frame 120 of the adjustable bed system via welding, or screws, or other connecting means. The first frame 110 and the second frame 120 can be aligned in the same plane (i.e., a plane state, FIGS. 9A, 10A and 11), or folded in a folded state (FIGS. 9B and 10B). As shown in FIGS. 9A-9B, 10A-10B and 11, the pivotally connected first end portions 371*a* and 372*a* of the first hinge bracket 371 and the second hinge bracket 372 are protruded from the first frame 110 and the second frame 120 of the adjustable bed system, such that when the first frame 110 and the second frame 120 are folded in the folded state (FIGS. 9B and 10B), the first frame 110 and the second frame 120 are spatially apart by the distance W6 (FIG. 9B), which provides a space for accommodating the back lifting assembly 103 and the leg lifting assembly 105 in the folded state.

Figure 6A:
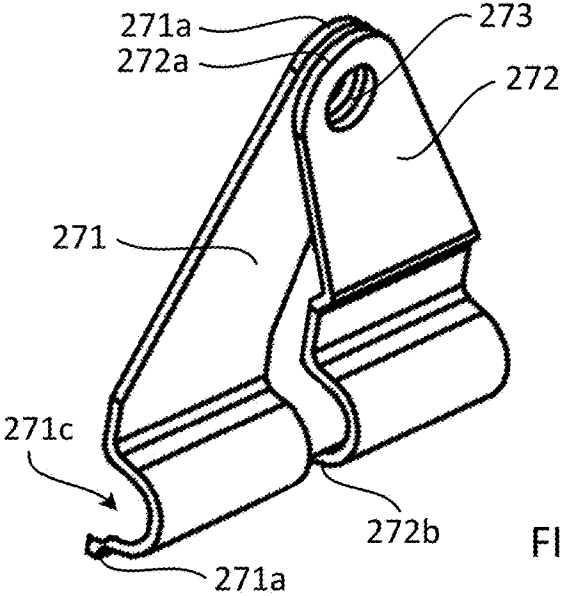
Figure 6B:
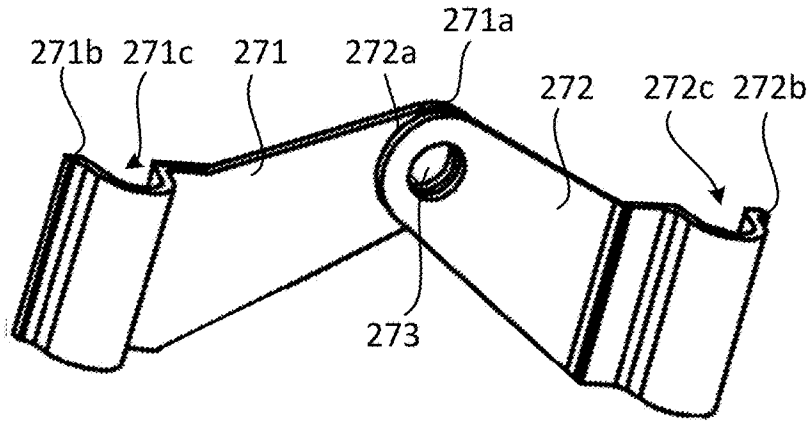

The foldable connection mechanism 370 is similar to the foldable connection mechanism 270 shown in FIGS. 6A-6B. However, none of the first hinge bracket 371 and the second hinge bracket 372 has a groove defined in the second end portion 371*b*/372*b* of said hinge bracket 371/372. That is, each hinge bracket 371/372 is devoid of grooves. In addition, the foldable connection mechanism 370 is also devoid of additional frame mounting brackets, a latch and any locking devices. Accordingly, such a design of the foldable connection mechanism 370 makes it be easily manufactured and installed, thereby reducing the cost of manufacture and also improving user's experience of installation.

Furthermore, other designs of the foldable connection mechanism, as disclosed in U.S. patent application Ser. Nos. 16/747,842 and 16/729,700, which are incorporated herein in their entireties by reference, can also be utilized to practice the invention.

In addition, as shown in FIGS. 1-3 and 11, the adjustable bed system also includes a plurality of platforms 180 disposed on the base frame structure 101 for supporting, for example, a mattress. The plurality of platforms 180 is coupled with the back lifting assembly 103 and the leg lifting assembly 105 such that positions of at least one or more of the plurality of platforms 180 are adjustable in accordance with operations of the back lifting assembly 103 and the leg lifting assembly 105. Said at least one or more of the plurality of platforms 180 have a plurality of openings 187 and 188, which some of the openings (e.g., openings 188) are adapted for accommodating massage devices 189 (FIGS. 3 and 11), while the others are for air ventilation, for example.

The plurality of platforms 180 includes two seat platform 182 and 183 mounted on the two side rails of the first frame 110 and/or the second frame 120 of the base frame structure 101.

The plurality of platforms 180 also includes a back platform 181 coupled to the back lifting assembly 103, such that the back platform 181 is operably rotatable around its lower edge in a back platform downward rotating direction or a back platform upward rotating direction.

The plurality of platforms 180 further includes a thigh platform 184 and a leg platform 185 coupled to the led lifting assembly 105. Specifically, the thigh platform 184 and the leg platform 185 are respectively coupled to the first leg lifting bracket 151 and the second leg lifting bracket 155, such that the thigh platform 184 is rotatable around its upper edge in a thigh platform downward rotating direction or a thigh platform upward rotating direction, and the leg platform 185 is rotatable around its upper edge in a leg platform downward rotating direction or a led platform upward rotating direction.

In one embodiment, the adjustable bed system further at least one leg support member 195 having one end pivotally connected to at least one of the pair of side rails of the second frame 120 through a pivot 196, and the other end coupled to the leg platform 185 (FIG. 3). Operably, there are a pair of leg support members 195 supporting the leg platform 185 when the leg platform 185 is lifted after the thigh platform 184 is lifted.

Figure 11:
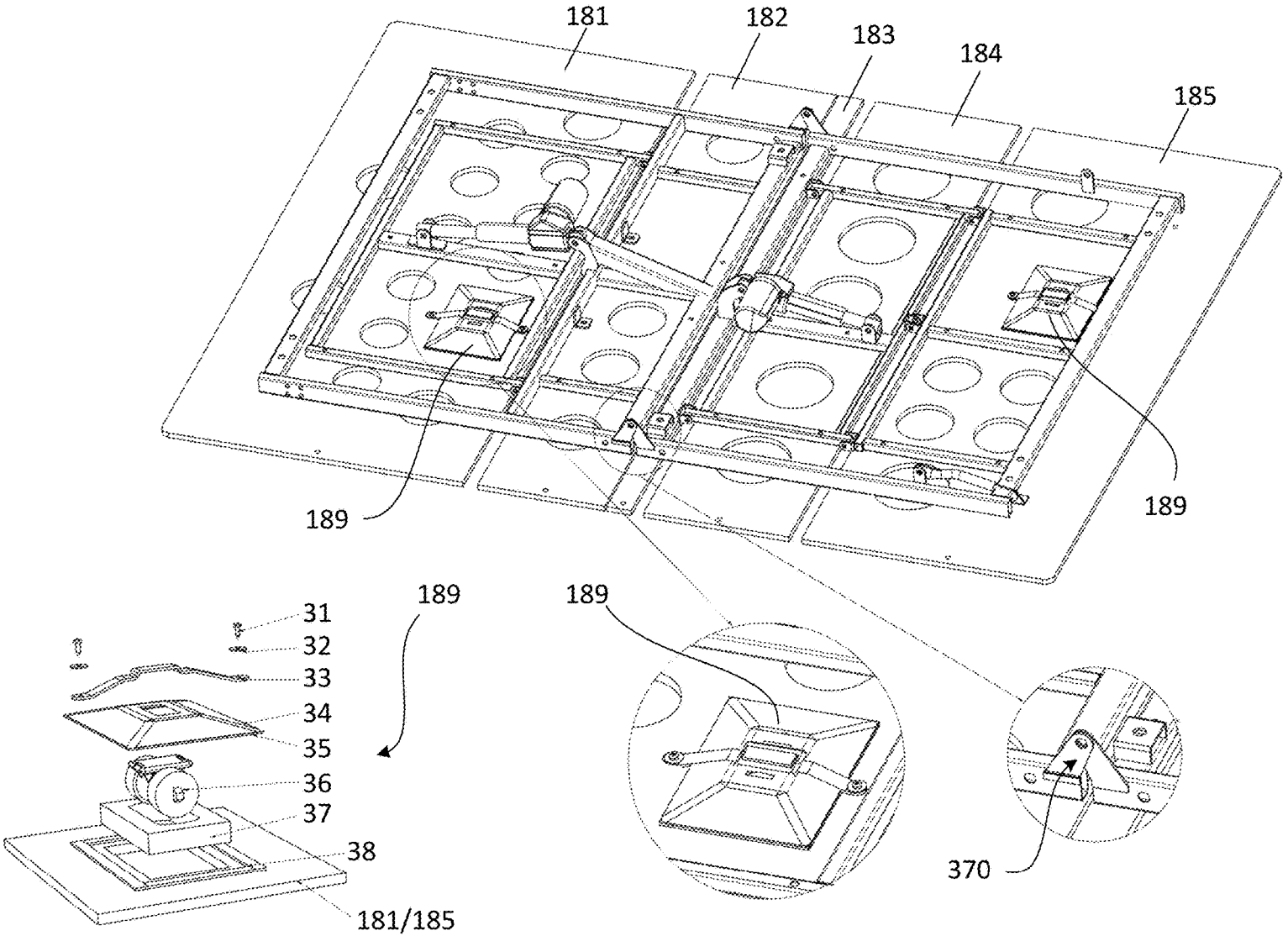
FIG. 11 shows schematically a back perspective view of the adjustable bed system having the connection mechanism shown in FIGS. 8A-8D.

As shown in FIGS. 3 and 11, the adjustable bed system further includes at least one massage assembly 189 received in openings 188 on one or more platforms, e.g., platforms 181 and 185, for providing massage effects to a user of the adjustable bed.

In one embodiment shown in FIG. 11, the massage assembly 189 includes a massage motor 36, an elastic belt 33, a massage motor cover 34, a velcro loop surface 35, a foam house 37, and a velcro hook surface 38. The velcro loop surface 35 and the massage motor cover 34 are connected. A side of the massage motor 36 passes through an opening of the massage motor cover 34, and the elastic belt 33 passes through the side of the massage motor 36 (the side of the massage motor 36 has a small opening for the elastic belt to pass through) to connect the components as a whole. Further, the velcro hook surface 38 is fixed onto the platform 181/185 (this may be done by a nail or any other connecting means not limited thereto). The foam house 37 is placed inside an opening of the platform 181/185, and the massage motor 36 as assembled above is placed inside a hole of the foam house 37 so that the velcro loop surface 35 and the velcro hook surface 38 are fit together. Finally, the massage motor 36 is fastened onto the platform 181/185 (this may be done via a pair of screws 31 and a pair of washers 32, but other connecting means may also be utilized). The massage motor can be easily replaced by simply removing the elastic belt 33 from the side of the massage motor 36 and separating the velcro surfaces.

Figure 2:
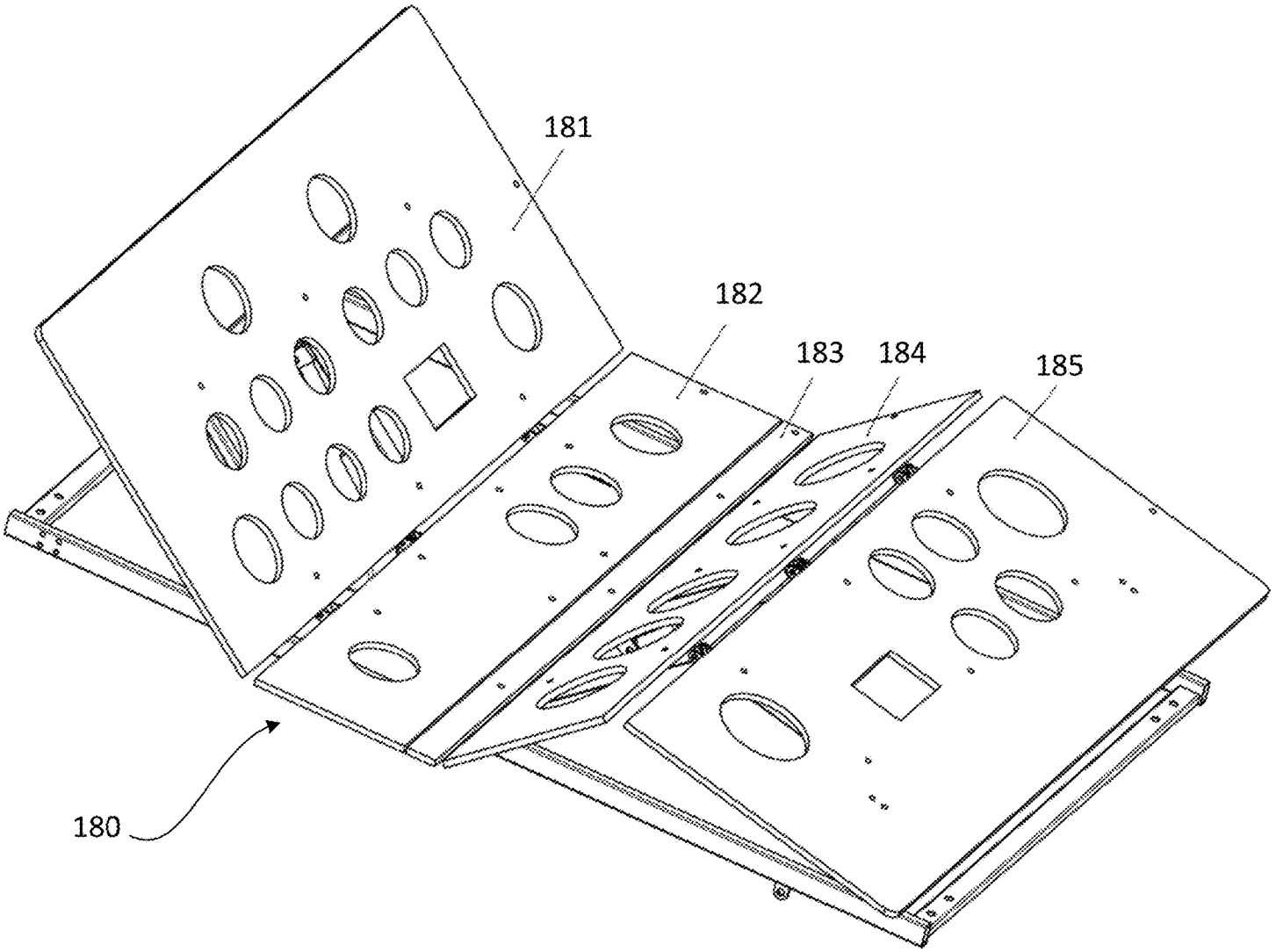
FIG. 2 shows schematically a front perspective view of the adjustable bed system shown in FIG. 1 in an adjusted state.

Furthermore, the adjustable bed system also includes a controller (not shown) configured to control operations of the at least one back lifting actuator 140 and the at least one leg lifting actuator 160, respectively, so as to lift individually or cooperatively the back platform 181, the thigh platform 184, and the leg platform 185 in desired positions, as shown in FIGS. 2-3.

In sum, the invention provides a bed system that is capable of adjusting body positions based on user's sleep preference so that the user achieves maximum comfort during sleep, and also is foldable so as to reduce the space for storage and transportation.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the invention pertains without departing from its spirit and scope. Accordingly, the scope of the invention is defined by the appended claims rather than the foregoing description and the exemplary embodiments described therein.

What is claimed is:

1. An adjustable bed system, comprising:

a base frame structure having a first frame and a second frame; and a foldable connection mechanism connecting the first frame and the second frame such that the first frame and the second frame are pivotally foldable relative to one another at the foldable connection mechanism, wherein the foldable connection mechanism comprises at least one connecting bracket assembly, each connecting bracket assembly comprising a first hinge bracket having a first end portion and a second end portion, and a second hinge bracket having a first end portion and a second end portion, wherein the first hinge bracket and the second hinge bracket are pivotally connected to one another through a pivot at the first ends, and wherein the first hinge bracket and the second hinge bracket are respectively mounted on two adjacent end portions of the first frame and the second frame of the adjustable bed system such that the first frame and the second frame are capable of positioning in a plane state or a folded state;

wherein the foldable connection mechanism further comprises a latch, and wherein each of the first hinge bracket and the second hinge bracket has a groove defined in the second end portion of said hinge bracket, wherein when the latch is received in the grooves of the first hinge bracket and the second hinge bracket, the first frame and the second frame are locked and aligned in the same plane, and when the latch is off at least one of the grooves of the first hinge bracket and the second hinge bracket, the first frame and the second frame are unlocked and pivotally foldable to each other through the pivot, wherein each connecting bracket assembly further comprises a frame mounting bracket having a body and two end tabs vertically extended from the body, and two protrusions outwards protruded from the two end tabs, respectively, and wherein in use, the body of the frame mounting bracket is mounted on one of the first frame and the second frame proximal to a corresponding one of the first hinge bracket and the second hinge bracket.

2. The adjustable bed system of claim 1, wherein each of the first end portions of the first hinge bracket and the second hinge bracket are constructed to have a hole, such that the first end portions of the first hinge bracket and the second hinge bracket are pivotally connected to one another through a pin or screw.

3. The adjustable bed system of claim 1, wherein the first hinge bracket and the second hinge bracket are constructed such that the first end portions of the first hinge bracket and the second hinge bracket are pivotally connected to one another through a male and female connecting means.

4. The adjustable bed system of claim 3, wherein one of the first end portions of the first hinge bracket and the second hinge bracket has a through hole and the other of the first end portions has a protruded pin or a protruded tube that is rotatably received in said through hole so that the first hinge bracket and the second hinge bracket are rotatable to one another at said protruded pin or tube.

5. The adjustable bed system of claim 1, wherein each of the first hinge bracket and the second hinge bracket is formed in a plane plate, or is formed such that the second end portion is slightly bended from the first end portion.

6. The adjustable bed system of claim 1, wherein a width of the first end portion of each of the first and second hinge brackets is less than that of the second end portion of said hinge bracket.

7. The adjustable bed system of claim 1, wherein the pivotally connected first end portions of the first hinge bracket and the second hinge bracket are protruded from the first frame and the second frame, such that when the first frame and the second frame are folded in the folded state, the first frame and the second frame are spatially apart by a distance thereby providing a space for accommodating a back lifting assembly and a leg lifting assembly of the adjustable bed system in the folded state.

8. The adjustable bed system of claim 1, wherein the latch comprises a pin and a tab having a first end vertically attached to a first end of the pin and a second end portion defining a notch, and wherein in use, when the pin is placed in the grooves of the first hinge bracket and the second hinge bracket and the tab is positioned such that the proximal protrusion of the frame mounting bracket is received in the notch, the first frame and the second frame are locked and aligned in the same plane, and when the pin is off at least one of the grooves of the first hinge bracket and the second hinge bracket the tab is positioned such that the distal protrusion of the frame mounting bracket is received in the notch, the first frame and the second frame are unlocked and pivotally foldable to each other through the pivot.

9. The adjustable bed system of claim 1, wherein each of the first and second frames comprises:

a pair of side rails and being transversely spaced and longitudinally extended and being parallel to each other, each side rail and having a first end and an opposite, second end; and an upper rail and a lower rail being longitudinally spaced and transversely extended, two ends of the upper rail being rigidly connected to the first ends of the pair of side rails and, and two ends of lower rail being rigidly connected to the second ends of the pair of side rails and, such that the upper rail and the lower rail and the pair of side rails are co-planar in a rectangle form.

10. The adjustable bed system of claim 1, further comprising at least one of a back lifting assembly and a leg lifting assembly, wherein the back lifting assembly comprises a back lifting bracket pivotally connected to the first frame, and at least one back lifting actuator pivotally connected between the back lifting bracket and the first frame for operably driving the back lifting bracket to pivotally move in an upward rotating direction or a downward rotating direction relative to the first frame; and wherein the leg lifting assembly comprises a leg lifting bracket pivotally connected to the second frame structure, and at least one leg lifting actuator pivotally connected between the leg lifting bracket and the second frame for operably driving the leg lifting bracket to pivotally move in an upward rotating direction or a downward rotating direction relative to the second frame.

11. The adjustable bed system of claim 10, wherein the at least one back lifting actuator comprises a motor member, an outer tube extending from the motor member, and an activation rod having a first end portion received in the outer tube and an opposite, second end portion, wherein the activation rod is engaged with the motor member and configured to be telescopically movable relative to the outer tube according to a direction of motor rotation, wherein the motor member is pivotally connected to the first frame and the second end portion of the activation rod pivotally connected to the back lifting bracket, or wherein the motor member is pivotally connected to the back lifting bracket and the second end portion of the activation rod pivotally connected to the first frame.

12. The adjustable bed system of claim 10, wherein the at least one leg lifting actuator comprises the at least one back lifting actuator comprises a motor member, an outer tube extending from the motor member, and an activation rod having a first end portion received in the outer tube and an opposite, second end portion, wherein the activation rod is engaged with the motor member and configured to be telescopically movable relative to the outer tube according to a direction of motor rotation, wherein the motor member is pivotally connected to the second frame and the second end portion of the activation rod pivotally connected to the leg lifting bracket, or wherein the motor member is pivotally connected to the leg lifting bracket and the second end portion of the activation rod pivotally connected to the second frame.

13. The adjustable bed system of claim 10, further comprising a plurality of platforms disposed on the base frame structure and coupled with the back lifting assembly and the leg lifting assembly such that positions of at least one or more of the plurality of platforms are adjustable in accordance with operations of the back lifting assembly and the leg lifting assembly.

14. The adjustable bed system of claim 13, wherein the plurality of platforms comprises at least one seat platform and mounted on the two side rails of the base frame structure;

a back platform coupled to the back lifting assembly, such that the back platform is operably rotatable around its lower edge in a back platform downward rotating direction or a back platform upward rotating direction; and a thigh platform and a leg platform coupled to the led lifting assembly, such that the thigh platform is rotatable around its upper edge in a thigh platform downward rotating direction or a thigh platform upward rotating direction, and the leg platform is rotatable around its upper edge in a leg platform downward rotating direction or a led platform upward rotating direction.

15. The adjustable bed system of claim 14, further comprising at least one massage device accommodated in at least one of the plurality of platforms for providing massage effects to a user of the adjustable bed system.

16. The adjustable bed system of claim 15, wherein the at least one massage device comprises a massage motor, and an elastic belt passing through a side of the massage motor and fastening the massage motor onto the at least one of the plurality of platforms.

17. The adjustable bed system of claim 15, further comprising a controller configured to control operations of the at least one back lifting actuator, the at least one leg lifting actuator, and the at least one massage device, so as to lift individually or cooperatively the back platform, the thigh platform, and the leg platform in desired positions, and provide massage effects.

* * * * *